United States Patent [19]

Henke et al.

[11] Patent Number: 4,547,916

[45] Date of Patent: Oct. 22, 1985

[54] MAGNETICALLY ACTUATED LEVEL INDICATOR

[75] Inventors: Arthur W. Henke; John M. Antos, both of Ann Arbor, Mich.

[73] Assignee: Thetford Corporation, Ann Arbor, Mich.

[21] Appl. No.: 551,659

[22] Filed: Nov. 10, 1983

[51] Int. Cl.[4] ..... E03D 1/00; E03D 3/00; E03D 5/00

[52] U.S. Cl. ..... 4/300; 4/321; 4/353; 4/661; 73/293; 73/317; 73/327; 73/DIG. 5; 137/558

[58] Field of Search ..... 4/300, 321, 353, 661; 73/317, DIG. 5, 293, 327; 137/558; 251/65

[56] References Cited

U.S. PATENT DOCUMENTS

| | | | |
|---|---|---|---|
| 2,592,929 | 4/1952 | Matchett | 73/DIG. 5 |
| 3,161,055 | 12/1964 | De Giers | 73/317 X |
| 3,949,430 | 4/1976 | Miller et al. | 4/321 |

*Primary Examiner*—Henry K. Artis
*Attorney, Agent, or Firm*—Stephenson & Boller

[57] ABSTRACT

A level indicator for a portable toilet comprises a visible indicator on the exterior of the toilet's holding tank, a float mechanism on the tank's interior operable to sense the level of liquid material in the tank, and a magnetic coupling between the float mechanism and the indicator for causing the indicator to be operated to a position corresponding to the level of liquid material sensed by the float mechanism. The indicator is in the form of a wheel journaled on a receptacle in the top wall of the holding tank. A magnet mounts on the wheel in radially spaced relation to its axis. The float mechanism comprises an arm which is operated along an arc in response to changes in the level of liquid material in the tank. The arm has a magnet which swings in a corresponding arc and which confronts the wheel magnet so that the wheel is rotated about its axis as the float arm is operated about its own axis. The wheel is enclosed by a bezel and lens assembly and the wheel contains indicial viewable through a window of the bezel and lens assembly. The float mechanism comprises a one-piece molded plastic element containing an integral hinge between a portion which mounts on the holding tank wall and another portion which forms the movably float arm. The construction requires no holes through the wall of the holding tank nor any separate fasteners.

21 Claims, 12 Drawing Figures

MAGNETICALLY ACTUATED LEVEL INDICATOR

BACKGROUND AND SUMMARY OF THE INVENTION

This invention relates to a liquid level indicator which is particularly useful for portable toilets.

A number of commonly assigned patents illustrate portable toilets of the type comprising a seat section mounted on a holding tank section. The seat section comprises a toilet bowl and a flush water storage reservoir. In use flush water is introduced into the toilet bowl through a suitable mechanism such as a hand-operated pump. After use a valve which is disposed between the bowl and the holding tank section is operated to allow the contents of the bowl to be deposited into the holding tank section. In this way the waste materials are accumulated in the holding tank section until the opportunity presents itself for dumping the contents of the holding tank section at an appropriate sanitary disposal station. In the type of portable toilet just described the holding tank section is separably mounted to the seat section so that only the holding tank section need be removed and dumped. Other designs of portable toilets may not be of this particular construction and may require the entire portable toilet to be brought to a disposal station for dumping.

In certain instances it may be either difficult or inconvenient to determine how full the holding tank is. In the aforementioned type of portable toilets it is obviously possible for one to open the valve and look into the holding tank. Needless to say this may be a rather unpleasant task due to exposure of the contents of the holding tank when the valve is open. Furthermore because the observer is looking down onto the surface of the contents of the holding tank it may be difficult to judge the level of the content. This is especially the case in confined and/or low light quarters where such toilets are often located.

Attempts to judge the contents of the holding tank by weight are also difficult. This is particularly the case for a portable toilet where the holding tank and seat sections are not separable. In the case of separable seat and holding tank sections the holding tank section may be separated and its contents judged after separation. This however is often an inconvenience since it requires that the seat section be removed; it is also only an approximation.

The present invention is, in one respect, directed to a new and improved arrangement for ascertaining how full the holding tank is without the inconvenience and unpleasantries often associated with prior procedures. More specifically the present invention is directed to a liquid level indicator which is associated with the holding tank section so as to provide a visible indication of the level of liquid within the holding tank without the need to do anything to the portable toilet. Due to the manner in which portable toilets are used the inclusion of a liquid level indicator requires a degree of sophistication which may not be readily appreciated. Because of the nature of waste materials it is important that the indicator and associated mechanism be impervious to the waste contents. From the standpoint of user acceptance it is desirable that waste material be excluded from view when one is viewing the indicator. From the standpoint of functionality, it is important that waste material be prevented from intruding into the indicator and associated mechanism where it might interfere with an accurate reading. It is also vital that the mounting of the indicator be leakproof for reasons of sanitation and user acceptance. Another consideration is that the indicator be of economical construction in relation to the cost of the toilet.

The present invention provides a liquid level indicator for a portable toilet which meets these objectives in an admirable fashion. The indicator and associated mechanism comprise a relatively small number of parts; are protected from and generally immune to the contents of the holding tank; mount on the tank without the use of any separate fasteners such as screws, bolts, etc.; have a leak-proof mounting because no holes through the tank wall are needed; and provide an accurate indication of the liquid level within the holding tank.

More specifically, in the preferred embodiment of the invention which is disclosed herein an upwardly open receptacle is provided in the top wall of the holding tank and is closed by a bezel and lens assembly to form a space for an indicator wheel which is journaled for rotation about a horizontal axis. The lower portion of the wheel is disposed within the receptacle and an upper portion of the wheel is disposed for view through the lens. A magnet is mounted on the wheel in radially spaced relation to its axis of its rotation and within the receptacle.

An operator for the wheel is disposed within the holding tank adjacent the receptacle. The operator comprises a float arm assembly which mounts on the holding tank for arcuate motion about a horizontal axis of rotation. The float arm assembly contains a float element and a magnet both in radially spaced relation to the axis of the float arm assembly. The level of liquid material within the tank angularly positions the float arm assembly about its axis. This also is effective to correspondingly angularly position the float arm assembly magnet. The magnet of the float arm assembly and that of the wheel are arranged such that there is an attractive force between the two. The arcuate motion of the float assembly magnet corresponds generally with that of the wheel magnet about the wheel's axis. The holding tank wall is of a nonmagnetic material. Hence, the angular position of the wheel is controlled by the float via the magnetic coupling passing through the holding tank wall. A suitable indicia is provided on the wheel which when viewed through the lens provides a visible indication of the level of liquid material within the holding tank.

The foregoing features, advantages and benefits of the invention, along with additional ones, will be seen in the ensuing description and claims which should be considered in conjunction with the accompanying drawings. The drawings disclose a preferred embodiment of the invention according to the best mode contemplated at the present time in carrying out the invention.

DESCRIPTION OF THE PREFERRED EMBODIMENT

Figure 1:
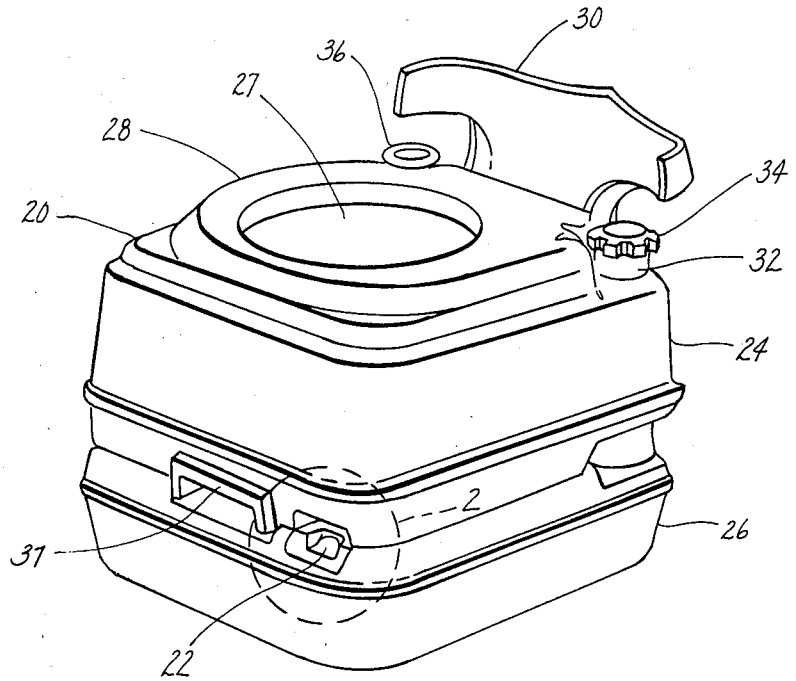
FIG. 1 is a perspective view, having a portion broken away, of a portable toilet having a level indicator embodying principles of the present invention.

FIG. 1 illustrates a portable toilet 20 comprising a level indicator 22 embodying principles of the present invention. The particular model of portable toilet which is illustrated in the drawing figure is merely exemplary and it will be appreciated that the liquid level indicator 22 may be used with a variety of models of portable toilets.

The illustrated portable toilet 20 comprises a seat section 24 and a holding tank section 26 which are separably mounted. Level indicator 22 is mounted on holding tank section 26. Seat section 24 comprises a bowl 27 and an overlying seat 28 and cover 30 which are hingedly mounted on this section. A flush water storage tank or chamber (not viewable) is located within the interior of section 24, and may be filled with fresh water via a fill port 32 which is covered by a removable cap 34. A pumping mechanism 36 is also provided for pumping fresh water from the water storage chamber into bowl 27 for use. After use a valve (not viewable) on the holding tank is operated by means of an operating handle 37 so that the contents of bowl 27 are discharged into holding tank 26. In this way holding tank 26 accumulates waste contents for later disposal at a suitable sanitary disposal station. Because of the separable mounting of the two sections 24 and 26, holding tank section 26 can be removed for dumping.

Figure 2:
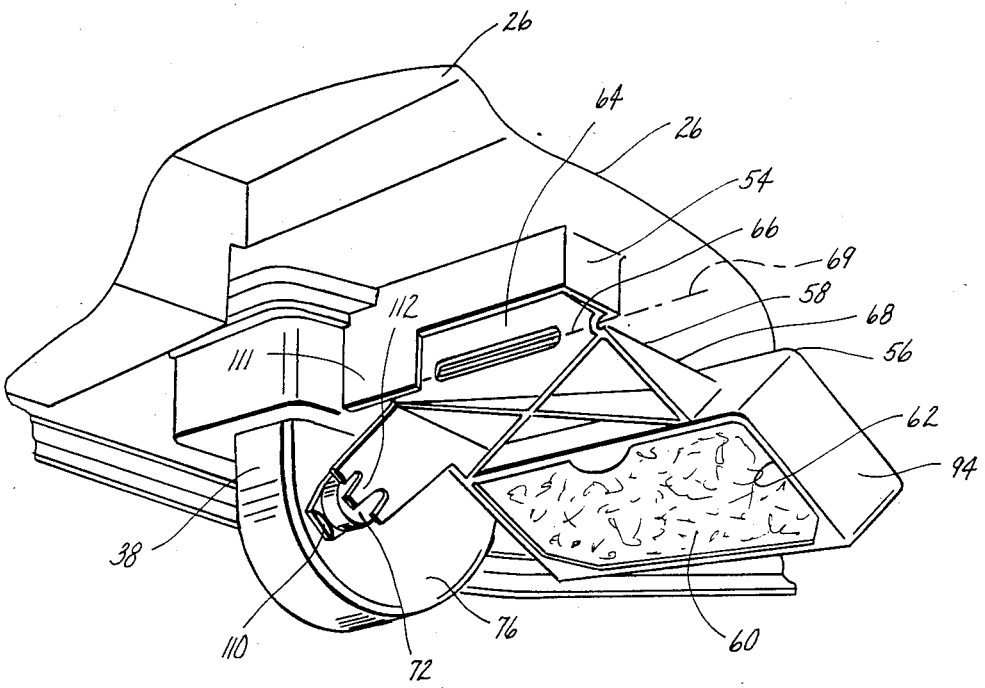
FIG. 2 is an enlarged exploded perspective view taken generally within circle 2 of FIG. 1, and looking from one direction.
Figure 3:
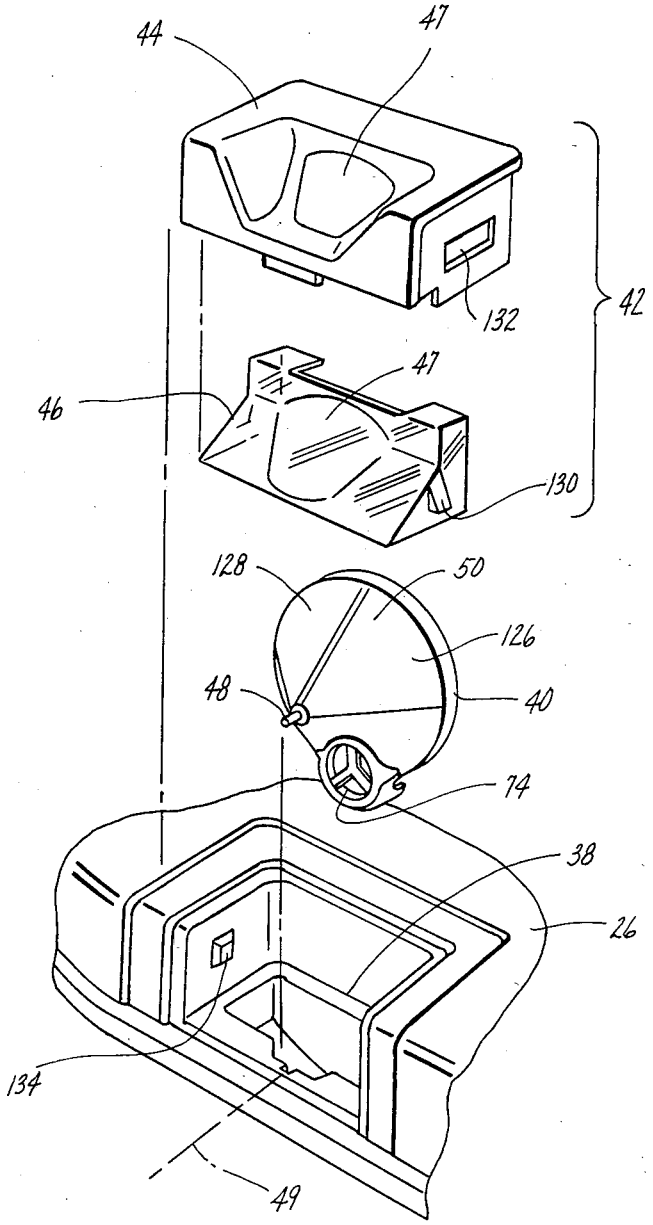
FIG. 3 is an enlarged perspective view taken generally within circle 2 of FIG. 1, and looking from another direction different from the direction of FIG. 2.

The general organization and arrangement of the level indicator of the present invention can be seen from the two perspective views of FIGS. 2 and 3.

The holding tank section top wall comprises a receptacle 38. Receptacle 38 is formed integrally with the holding tank during fabrication of the top half of the holding tank section in accordance with conventional procedures.

An indicator wheel 40 is cooperatively associated with receptacle 38 such that a lower portion of the wheel, approximately the lower half, is disposed within the receptacle. A bezel and lens assembly 42, comprising a bezel 44 and a lens 46, fits over the receptacle to enclose wheel 40. The bezel and lens assembly provides a viewing window 47 through which a portion of the upper half of wheel 40 may be viewed when the indicator components are assembled.

Wheel 40 comprises an integral axle 48 which serves to journal wheel 40 for rotary motion on the receptacle about a horizontal axis 49. Indicia, in the form of a decal 50, is provided on the front face of wheel 40 for viewing through window 47. This provides a visible indication of the level of liquid material within the holding tank.

A socket 54 is provided on the interior of the holding tank on the inside of the holding tank top wall. Like receptacle 38, socket 54 is integrally formed during fabrication of the top half of the holding tank. The illustrated socket 54 is of a generally rectangular shape.

A float arm assembly 56 mounts within the holding tank and comprises a one-piece plastic element 58 and a buoyant float element 60. Float element 60 is assembled into a float receiving compartment 62 of element 58. Element 58 also comprises a mounting plug 64 which fits into socket 54 to mount element 58 on the interior of the top wall of the holding tank. Plastic element 58 further comprises an integral hinge 66 joining plug 64 and an arm portion 68. The hinge axis is identified by reference numeral 69. When the float arm assembly is mounted on the holding tank, float element 60 will be buoyed to the level of liquid material within the holding tank. This in turn pivotally positions arm portion 68 about axis 69 of hinge 66.

Arm portion also has a receptacle 70 containing a ceramic magnet 72 in radially spaced relation to axis 69. Hence as arm portion 68 swings arcuately about axis 69, magnet 72 swings along an arc.

Wheel 40 also contains a magnet 74. The magnets 72 and 74 are arranged such that there is an attractive force between them. The magnetic force freely passes through the wall of the holding tank receptacle because the material of the holding tank is plastic and hence nonmagnetic. As the float arm magnet swings along its arcuate path, the wheel's magnet 74 follows and correspondingly angularly positions wheel 40 within receptacle 38 about axis 49. This operation is effective to change the position of indicator decal 50 within viewing window 47 and thereby provide a visible indication which is correlated with the level of liquid material in the holding tank.

The level indicator may be assembled without the use of any separate attaching parts, and it will be observed that there are no holes through the receptacle or the wall of the holding tank for purposes of mounting the level indicator and operatively coupling the interior and exterior component parts.

Assembly of the wheel to the holding tank is accomplished by appropriately positioning the wheel and dropping it into the receptacle so that the ends of axle 48 are properly journaled. The lens and bezel are assembled together to form assembly 42 and the assembly is fitted over and onto receptacle 38 to enclose wheel 40. As can be seen from the earlier description, the float arm assembly is assembled by inserting plug 64 into socket 54.

With this general description in mind it is now appropriate to consider further details of the construction.

Figure 4:
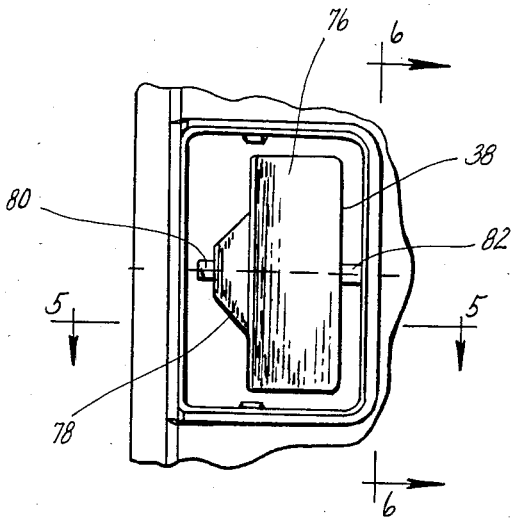
FIG. 4 is a fragmentary top plan view of a portion of the portable toilet by itself.
Figure 5:
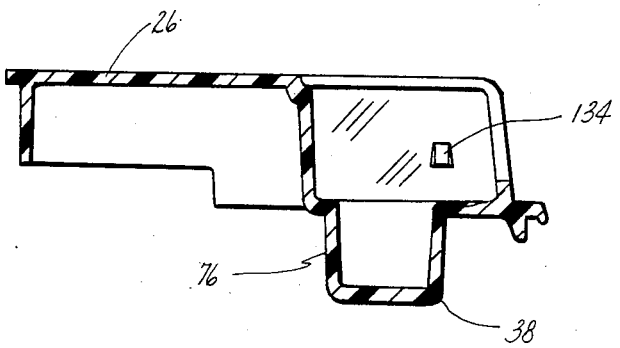
FIG. 5 is a fragmentary vertical cross sectional view taken in the direction of arrows 5—5 in FIG. 4.
Figure 6:
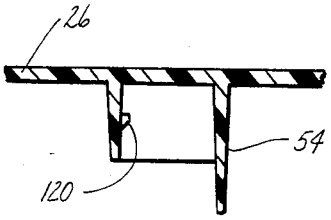
FIG. 6 is a fragmentary vertical cross sectional view taken in the direction of arrows 6—6 in FIG. 4.

FIGS. 4, 5 and 6 illustrate details of receptacle 38. Receptacle 38 comprises a main generally semi-circular portion 76, with a tapering portion 78 extending forwardly from portion 76. The shapes of these portions 76 and 78 are dimensioned to receive the lower portion of the wheel when the wheel is oriented in the manner shown in FIG. 3. Receptacle 38 is provided at opposite axial ends with integrally formed bearing surfaces 80 and 82 which journal opposite ends of axle 48. The bearing surface 80 at the front end of the receptacle is generally parallel to the axis of rotation of the wheel. The other bearing surface 82 at the rear of the receptacle is tapered.

Figure 10:
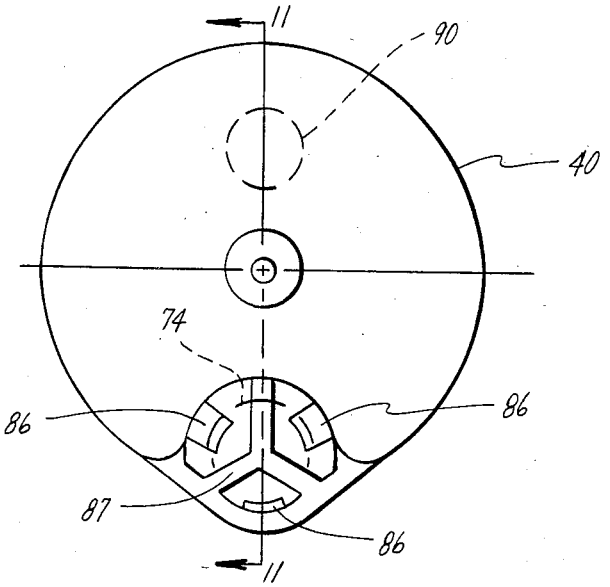
FIG. 10 is a front view of one of the components shown by itself.
Figure 11:
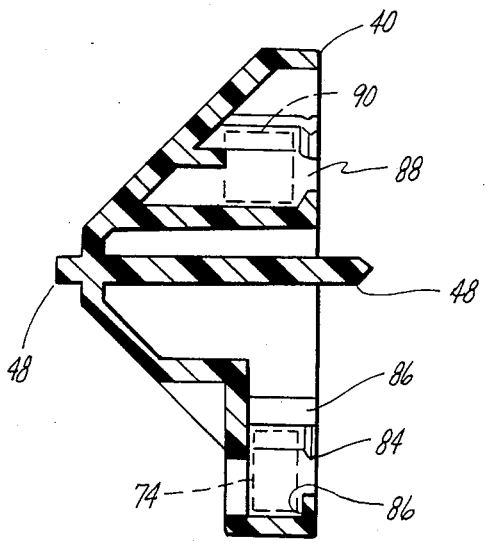
FIG. 11 is a sectional view taken in the direction of arrows 11—11 in FIG. 10.

Referring to FIGS. 10 and 11, the reader will observe the following specific details of wheel 40. Wheel 40 is of a one-piece molded plastic construction, a polyester being the preferred plastic for purposes of dimensional stability and durability characteristics. While the wheel is of a generally circular shape, its front face is tapered and its lower portion departs slightly from the generally circular shape. This shape is to provide for the mounting of magnet 74.

The wheel is provided with a rearwardly open receptacle 84 into which a circular cylindrical magnetic disc forming magnet 74 may be removably inserted. The receptacle is defined by a plurality of spaced fingers 86 having catches at their free ends. The magnet may be inserted into the receptacle from the rear with the fingers flexing outwardly to allow the magnet to pass into the receptacle and then resiliently returning once the magnet has cleared the catches so that the catches axially hold the magnet in place. The forward wall 87 of receptacle 84 is in the form of a web to facilitate fabrication of the one-piece plastic wheel.

The wheel is also provided with a second receptacle 88 diametrically opposite receptacle 84. The purpose of the second receptacle is to receive a metal slug 90 forming a counterweight so as to approximately statically balance the wheel. The counterweight is inserted into its receptacle in the same manner as magnet 74 was inserted into receptacle 84. The construction provides a balance which is desirable to improve the operating characteristics of the indicator over an unbalanced construction.

The forward end of axle 48 which is journaled on front bearing surface 80 has a generally circular cylindrical cross section. The rear end of axle 50 however has a frusto-conically tapered shape. The angle of the taper is less than the corresponding angle of the tapered bearing surface 82. This ensures a substantially point contact of the pointed rear end of the axle on the rear bearing surface 82. It also is effective to promote a point contact of the front end of the axle on the front bearing surface 80. This occurs because the attractive force between the two magnets will tend to pivot the wheel very slightly in a counterclockwise sense in the manner indicated by arrows 92 in FIG. 11. This will result in a very slight tipping of the axis of the axle so that there is a point contact of the forward end of the axle on bearing support 80 yet the larger included angle of the rear bearing support 82 still permits a point contact of the pointed rear end of the axle to be maintained with the rear bearing support 82.

The drawing figures illustrate further details of the one-piece plastic element 58. This element is preferably of a material which permits hinge 66 to be integrally formed between plug 64 and arm portion 68 as a "living hinge". Polypropylene is a suitable material.

Compartment 62 has a continuous outer boundary wall 94 of generally trapezoidal shape. One side of the compartment (the right side as viewed in FIG. 8) is substantially open and the opposite side is substantially closed. This construction permits the resilient float element, which incidentally is a closed cell foam having a shape corresponding to that of the trapezoidal boundary wall 94, to be compressed and inserted into the compartment via the compartment's generally open side. The foam then resiliently expands to its free trapezoidal shape to be captured between the substantially closed side and three tabs 96, 98, 100 at the substantially open side. The substantially closed side comprises three openings each of which is directly opposite one of the tabs 96, 98, 100. These openings are of the same general shape as the corresponding tabs but are slightly magnified. Their purpose is to facilitate the molding of tabs 96, 98, 100 during the molding of element 58.

Arm portion 68 comprises three sides, 102, 104, 106 bridged by diagonal bracing 108. Receptacle 70 is open to the right as viewed in FIG. 8 to permit insertion and removal of magnet 72. The receptacle is provided with a catch 110 on one side and a finger 112 on the opposite side which serve to retain the magnet in the receptacle after the magnet has been inserted. The construction also permits the magnet to be removed from the receptacle by flexing the catch and finger out of the way to provide clearance.

In order to provide the desired hinging action so that the float arm assembly and indicator operate in the intended manner, it is important to control the dimensions of hinge 66. The hinge must provide sufficient sensitivity to allow the arm portion 68 to follow changes in the level of liquid material. Thus, it must not be unduly stiff. On the other hand, it must not be so flimsy and insubstantial that it may fail. For the sake of compactness, it is desirable for the float element to be as small as possible; yet the plug and arm portions 64 and 68 of element 58 must have sufficient strength and form to maintain dimensional stability. Considerations of the molding process itself also impose constraints.

Figure 9:
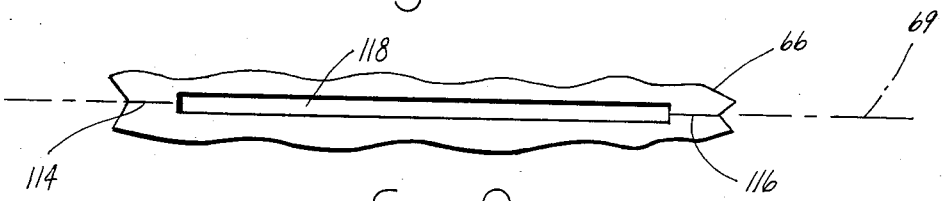
FIG. 9 is a fragmentary view illustrating further detail of one of the components of FIG. 7.

A very satisfactory construction is obtained by constructing the hinge so that it is of a discontinuous nature. It will be observed that hinge 66 comprises hinging segments 114, 116 at its ends and these are separated by a gap of rather appreciable length, (see FIG. 9).

Plug 64 is constructed with an opening 118 in one of its walls. The plug itself is constructed to fit closely within socket 54. The socket is provided with a catch 120 for association with opening 118 when the plug is fully inserted into the socket. During insertion of the plug into the socket there is sufficient flexing so that the plug clears catch 120. However when opening 118 registers with catch 120, the catch lodges within the opening to thereby retain the plug in the socket. While this provides a very satisfactory mounting arrangement, it is possible by means of a tool or otherwise to flex the catch out of the way and remove the plug from the socket.

The construction of the one-piece molded plastic element 58 is advantageous from the fabrication standpoint in that it is of generally uniform wall thickness throughout except at the hinge segments 114, 116 which are of reduced thickness to provide the desired hinging action.

Figure 8A:
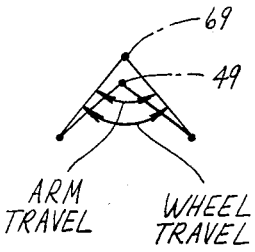
FIG. 8A illustrates in diagrammatic fashion further details of the operative arrangement between the wheel and the float arm assembly.
Figure 8:
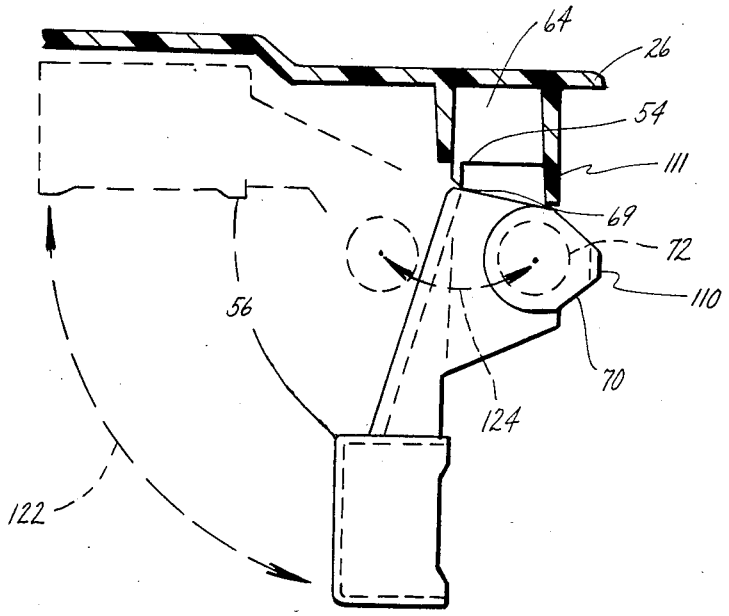
FIG. 8 is a vertical view taken generally in the direction of arrows 8—8 in FIG. 7 and illustrating plural operative positions.

FIG. 8 illustrates in solid lines a position which the float arm assumes when the level of liquid material in the tank is below a certain minimum. As the level increases, the flow is buoyed by the liquid material with the float arm always assuming a position corresponding to the level of the liquid material. In this way the float arm is positioned angularly about hinge axis 69 along an arc 122 with each position being correlated with a particular level of liquid material in the tank. Magnet 72 is correspondingly positioned along an arc 124 and in turn correspondingly positions wheel 40 about axis 49 because of the magnetic coupling between the two magnets.

When the float arm is in the solid line position of FIG. 8, magnet 72 is approximately at the four o'clock position about hinge axis 69. When the float arm is in the broken line position (corresponding to full), magnet 72 is about at the eight o'clock position with respect to axis 69. Hinge axis 69 and wheel axis 49 are approximately colinear so that as the tank goes from empty to full, the wheel magnet 74 moves from the four o'clock position about axis 49 to about the eight o'clock position about axis 49.

Decal 50 on the front face of wheel 40 may take any of various possible forms. One possible form is a two-color decal in which one-half of the arcuate extent is one color 126 and the other half another color 128. Color 126 is intended to represent empty and color 128, full. The decal is of such dimensions and is so positioned on wheel 40 that when the float arm is in the solid line position of FIG. 8 corresponding to the tank being empty and the two magnets at their four o'clock positions, the entirety of color 126 appears in window 147. As the level of liquid material in the tank increases, the dividing line between the two colored segments of the decal moves across the window so that the proportion of color 126 decreases while that of color 128 increases. When the tank is full (corresponding to the broken line position of FIG. 8), color 128 entirely appears in window 47. In this way, the relative proportions of the two colors in the viewing window are indicative of the extent to which the holding tank is filled.

The materials of the level sensor are immune from the contents of the usual materials which may be introduced into the holding tank. Preferably the float arm magnet is ceramic so as to avoid corrosion.

Bezel 44 and lens 46 are fabricated from suitable plastics with the lens being transparent and the bezel opaque. The lens is provided with catches 130 at its sides which snap into openings 132 in the sides of bezel 44 when the two are properly assembled together. Receptacle 38 is provided with catches 134 on opposite sides which also snap into the bezel's openings 132 when the bezel and lens assembly is assembled to the holding tank. The window opening 47 in bezel 44 flexes slightly when the lens is snapped into the bezel so as to prevent rattling. Because of the snap fit assembly, it is possible to disassemble the snap fitted components by suitable tools or other means. Thus if maintenance is ever necessary, it can be accomplished, yet the construction possesses beneficial assembly and retention characteristics.

It will be observed that the construction requires no through-holes in the wall of the tank nor are any separate fasteners or adhesives required.

The use of counterweight 90 for wheel 40 is advantageous not only in facilitating the operation of the wheel but also because it tends to avoid slippage of the wheel as the wheel is operated to positions where the wheel magnet is in other than the six o'clock position. In the absence of the counterweight, the weight of the wheel magnet creates a torque tending to urge the wheel to a position where the wheel magnet is at six o'clock. This torque increases as the position of the wheel magnet departs from the six o'clock position in an unbalanced wheel. The effect of unbalance is slippage between the two magnets thereby detracting from the accuracy of the indicator as the wheel increasingly departs from the six o'clock position of its magnet.

Receptacle 38 and the construction of wheel 40 are such that it is possible to assemble the component parts together only when the wheel is properly positioned. Moreover, with the wheel properly journaled, the protruding lower portion of the wheel which departs from its otherwise generally circular shape will abut the receptacle if attempts are made to rotate the wheel beyond about its eight o'clock and its four o'clock positions.

Figure 7:
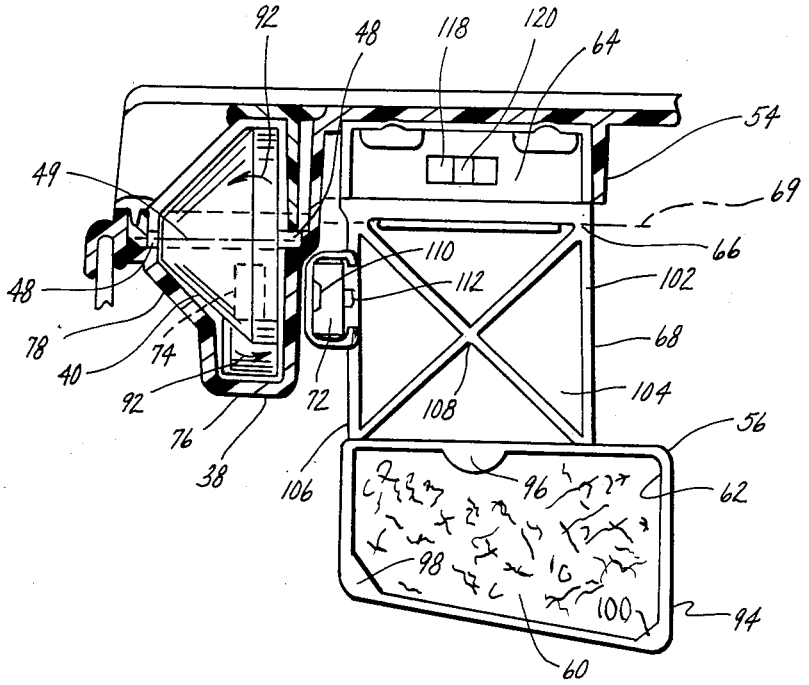
FIG. 7 is a vertical view, partly in cross section, illustrating the level indicator components in assembled relationship on the portable toilet.

As can be seen in FIG. 7 the lens and bezel assembly overlies the ends of axle 48 so as to prevent them from coming out of the bearing support surfaces 80 and 82. In this way, it is impossible for a "phase reversal" of the wheel to occur within the assembly whereby the counterweight, rather than the wheel magnet, would be acted upon by the float arm magnet.

The magnets are each polarized in their respective axial directions. In order to provide the desired attractive force between them, opposite poles of the magnets should confront each other.

FIG. 8A illustrates in diagrammatic fashion further details of the operative arrangement between wheel 40 and float arm assembly 56. Although it has been noted previously that axis 49 and axis 69 are generally co-linear, the latter is in fact spaced a short vertical distance above axis 49 although the two are substantially parallel. The radius about axis 49 of the center of the wheel magnet is slightly less than the radius of the center of the float arm assembly magnet about axis 69. With this arrangement, a given increment of angular travel of the float arm magnet about axis 69 will produce a slightly greater angular increment of travel of the wheel magnet about axis 49. In other words, the angular motion of the float arm is slightly amplified insofar as its effect on the wheel motion is concerned. Where it is desired to have a given range of rotation for the indicator, this means that the float must traverse a lesser distance than would otherwise be required if there were no multiplication and this further means that a given indicator may be used with shallower holding tanks.

It will also be observed in FIG. 8A that the geometry is such that the axes of the magnets are colinear at the ends of travel. This means at the full and empty positions, there is always the maximum attraction force between the two magnets and in turn this yields improved end-of-scale accuracy which may be deemed more important that mid-range accuracy.

Other geometries are possible using principles of the invention. For one example, the multiplication factor may be varied; for another, the point of alignment of the two magnets may be set anywhere along the range of travel.

A stop, such as indicated at or in the vicinity of 111, limits the travel of the float arm in the counterclockwise sense, as viewed in FIG. 8, so that when the tank contents rise above the empty level to buoy float 60, clockwise motion of the float arm is assured.

While a preferred embodiment of the invention has been disclosed, it will be appreciated that principles are applicable to other embodiments.

What is claimed is:

1. In a portable toilet having a tank for containing liquid material associated with use of the toilet, a level indicator comprising a visible indicator disposed in an open receptacle on the exterior of the tank, a float mechanism on the interior of the tank operable to sense the level of liquid material in the tank, a magnetic coupling between the float mechanism and the indicator for causing the indicator to be operated to a position corresponding to the level of liquid material sensed by the float mechanism within the tank and a bezel and lens assembly fitting over said indicator to close the receptacle, said bezel and lens assembly providing a viewing window through which a portion of the indicator is visible, said indicator containing indicia visible through the window to provide an indication of the level of liquid material in the tank.

2. A level indicator as set forth in claim 1 in which said visible indicator comprises a wheel journaled for rotation about a horizontal axis.

3. A level indicator as set forth in claim 2 in which said wheel comprises an axle via which the wheel is journaled for rotation, said tank having bearing support surfaces for supporting the axle at its ends.

4. A level indicator as set forth in claim 3 in which the magnetic coupling is effective on the wheel at a level below that of its axis of rotation, said axle ends and said bearing support surfaces being so constructed as to provide point contacts of the axle at its ends with the bearing support surfaces.

5. In a portable toilet having a tank for containing liquid material associated with use of the toilet, a level indicator comprising a visible indicator on the exterior of the tank, a float mechanism on the interior of the tank operable to sense the level of liquid material in the tank, a magnetic coupling between the float mechanism and the indicator for causing the indicator to be operated to a position corresponding to the level of liquid material sensed by the float mechanism within the tank, in which said visible indicator comprises a wheel journaled for rotation about a horizontal axis, and in which said magnetic coupling comprises a magnet on said wheel at a level below that of its axis of rotation, said tank having a receptacle receiving a lower portion of said wheel, and said receptacle and wheel being so constructed that with the wheel journaled for rotation, its range of rotation is limited by the receptacle.

6. A level indicator as set forth in claim 5 including a counterweight on said wheel diametrically opposite the location of said magnet.

7. In a portable toilet having a tank for containing liquid material associated with use of the toilet, a level indicator comprising a visible indicator on the exterior of the tank, a float mechanism on the interior of the tank operable to sense the level of liquid material in the tank, a magnetic coupling between the float mechanism and the indicator for causing the indicator to be operated to a position corresponding to the level of liquid material sensed by the float mechanism within the tank, in which said visible indicator comprises a wheel journaled for rotation about a horizontal axis, and including a bezel and lens assembly fitting over said wheel, said bezel and lens assembly providing a viewing window through which a portion of the wheel is visible, said wheel containing indicia visible through the window to provide an indication of the level of liquid material in the tank.

8. A level indicator as set forth in claim 7 in which the lens is snap-fitted into the bezel and the bezel snap fits onto the tank and cooperatively associates with a receptacle portion of the tank to retain the wheel journaled on the tank.

9. In a portable toilet having a tank for containing liquid material associated with use of the toilet, a level indicator comprising a visible indicator on the exterior of the tank, a float mechanism on the interior of the tank operable to sense the level of liquid material in the tank, a magnetic coupling between the float mechanism and the indicator for causing the indicator to be operated to a position corresponding to the level of liquid material sensed by the float mechanism within the tank, and in which said float mechanism comprises a one-piece molded plastic element having a first portion mounting on the tank wall within the tank's interior, an integral hinge joining with said first portion, said hinge having a generally horizontal axis, a second portion joining with said hinge opposite said first portion, said second portion being pivotable about the hinge axis relative to said first portion so as to respond to the level of liquid material within the tank, said magnetic coupling being operated by said second portion to correspondingly position said indicator.

10. A level indicator as set forth in claim 9 in which said magnetic coupling includes a magnet on said second portion in spaced relation to the axis of said hinge so as to be operated along an arcuate path of travel as said second portion responds to the level of liquid material in the tank.

11. A level indicator as set forth in claim 10 including a receptacle on said second portion spaced outwardly of said magnet, said receptacle containing a buoyant float element.

12. A level indicator as set forth in claim 10 in which said first portion comprises a plug, said tank having a socket within which said plug is disposed, and a catch for releasably retaining said plug in said socket.

13. A level indicator as set forth in claim 12 in which said hinge is of discontinuous form comprising spaced apart hinge segments separated by a gap along the length of the hinge axis.

14. A level indicator as set forth in claim 9 in which said visible indicator comprises a wheel journaled for rotation about a horizontal axis.

15. A level indicator as set forth in claim 14 in which said wheel comprises an axle via which the wheel is journaled for rotation on the tank, said tank having bearing support surfaces for supporting the axle at its ends, and a magnet on said wheel at a level below that of the wheel axle, and a magnet on said second portion in attracting relationship with said wheel magnet.

16. A level indicator as set forth in claim 15 in which the coupling between the two magnets is at a level below that of the wheel axle, said axle ends and said bearing support surfaces being so constructed as to provide point contacts of the axle at its ends with the bearing support surfaces.

17. A level indicator as set forth in claim 16 including a counterweight on the wheel diametrically opposite the location of the wheel magnet.

18. A level indicator as set forth in claim 17 including a lens and bezel assembly fitting over said wheel, said bezel and lens assembly providing a viewing window through which a portion of the wheel is visible, said wheel containing indicia visible through the window to provide an indication of the level of liquid material in the tank.

19. A level indicator as set forth in claim 18 in which the lens is snap-fitted into the bezel and the bezel snap fits onto the tank and cooperatively associates with a receptacle portion of the tank to retain the wheel journaled on the tank.

20. A portable toilet comprising a tank for containing liquid material associated with use of the tank, said tank having an imperforate wall portion and a level indicator disposed on the exterior of said tank at said imperforate wall portion, said indicator comprising visible indicia, a float mechanism on the interior of the tank operable to sense the level of liquid material in the tank and an operative magnetic circuit coupling passing through said imperforate wall portion between the float mechanism and the indicator for causing the indicator to be operated to a position corresponding to the level of liquid material sensed by the float mechanism within the tank.

21. A portable toilet as set forth in claim 20 in which said tank is a waste holding tank.

* * * * *